US005102381A

United States Patent [19]

Danielak et al.

[11] Patent Number: 5,102,381

[45] Date of Patent: Apr. 7, 1992

[54] BUBBLE PRODUCING JUMP ROPE

[75] Inventors: Ann Danielak, Wilmette; Randall J. Klimpert, Chicago; John R. Wildman, North Riverside; Horst D. Herbstler, Bolingbrook; Burton C. Meyer, Downers Grove; Robert Wildman, Berwyn, all of Ill.; Russell Gold, Pittsburgh, Pa.

[73] Assignee: Meyer/Glass Design, Chicago, Ill.

[21] Appl. No.: 726,398

[22] Filed: Jul. 5, 1991

[51] Int. Cl.[5] ..... A63B 5/20

[52] U.S. Cl. ..... 482/82; 482/81; 446/15

[58] Field of Search ..... 272/74, 75; 446/15; 401/195, 292

[56] References Cited

U.S. PATENT DOCUMENTS

| | | | |
|---|---|---|---|
| 2,229,801 | 1/1941 | Dozier | 272/75 |
| 2,928,205 | 3/1960 | Fulton | 446/15 |
| 3,481,600 | 12/1969 | Lang. Sr. et al. | 272/74 |
| 3,745,693 | 7/1973 | La Fata et al. | 446/15 |
| 3,958,362 | 5/1976 | Kessler | 446/15 |
| 4,079,932 | 3/1978 | Schuetz | 272/75 |
| 4,315,623 | 2/1982 | Granderson | 272/74 |
| 4,790,787 | 12/1988 | Rector | 446/15 |
| 4,919,417 | 4/1990 | Poulas | 272/75 |
| 5,022,646 | 6/1991 | Kessler | 272/75 |

*Primary Examiner*—Richard J. Apley
*Assistant Examiner*—D. F. Crosby

[57] ABSTRACT

A jump rope which produces bubbles as it is rotated. A hollow liquid containing handle is located at each end of the jump rope. A bubble diffusor is positioned near each handle. A flexible liquid transporting tube connects each handle with its bubble diffusor. Each bubble diffusor includes coaxial tubes having an annular space between the tubes. Aligned openings are formed in the inner and outer coaxial tubes. The liquid bubble producing solution moves from the handles to the annular space between the tubes of the diffusor as the rope is rotated during jumping. The liquid bubble producing liquid spreads across the openings. Air passing through the openings in the coaxial tubes produces bubbles.

5 Claims, 1 Drawing Sheet

BUBBLE PRODUCING JUMP ROPE

BACKGROUND AND SUMMARY OF THE INVENTION

This invention is directed to a novel jump rope that will produce bubbles as a person, such as a child, jumps the rope.

An object of this invention is a novel jump rope which continuously produces bubbles as it is rotated.

Another object of this invention is a bubble producing jump rope which is easily filled with a liquid bubble solution.

Another object of this invention is a novelty jump rope having simple, yet efficient, bubble diffusors.

Other objects of the invention may be found in the following specification, claims and drawings.

BRIEF DESCRIPTION OF THE DRAWINGS

The invention is illustrated more or less diagrammatically in the following drawings wherein.

DESCRIPTION OF THE PREFERRED EMBODIMENT

Figure 1:
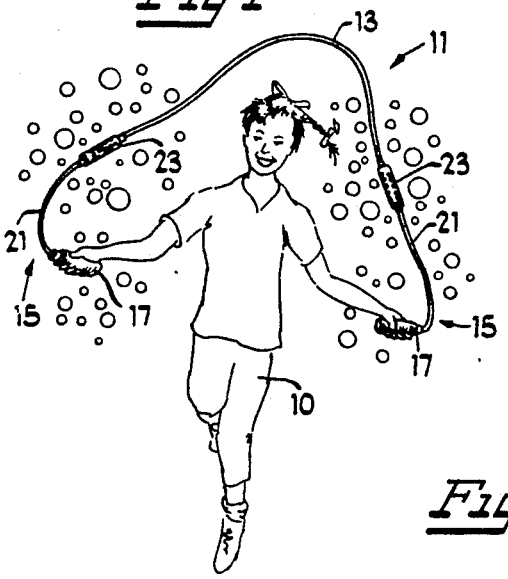
FIG. 1 is a perspective view of a person using the novel bubble producing jump rope of this invention.
Figure 2:
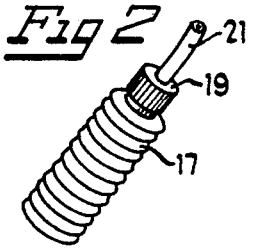
FIG. 2 is an enlarged perspective view of one of the bubble solution containing jump rope handles shown in FIG. 1.

FIG. 1 of the drawings shows a child 10 playing with the novelty jump rope 11 of this invention to produce bubbles. The jump rope includes a solid, rope-like middle portion 13 which may be formed of a solid vinyl. Located at the ends of the rope portion 13 are bubble producing means 15. Each bubble producing means 15 includes a hollow bottle-like handle 17 (FIG. 2) which is formed of plastic with an accordion shaped wall . Each handle 17 has a screw-on cap 19 at one outer end providing access to the hollow interior of the handle for filling the handle with liquid bubble solution. A flexible tube 21 also formed of vinyl extends through the cap 19 of the handle 17 to a bubble diffusor 23.

Figure 4:
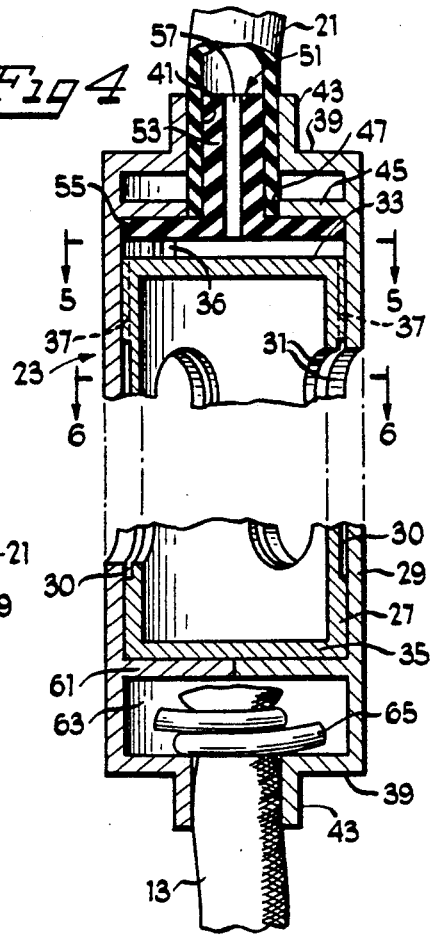
FIG. 4 is an enlarged, longitudinal, cross-sectional view of the bubble diffusor of FIG. 3, with parts broken away.
Figure 3:
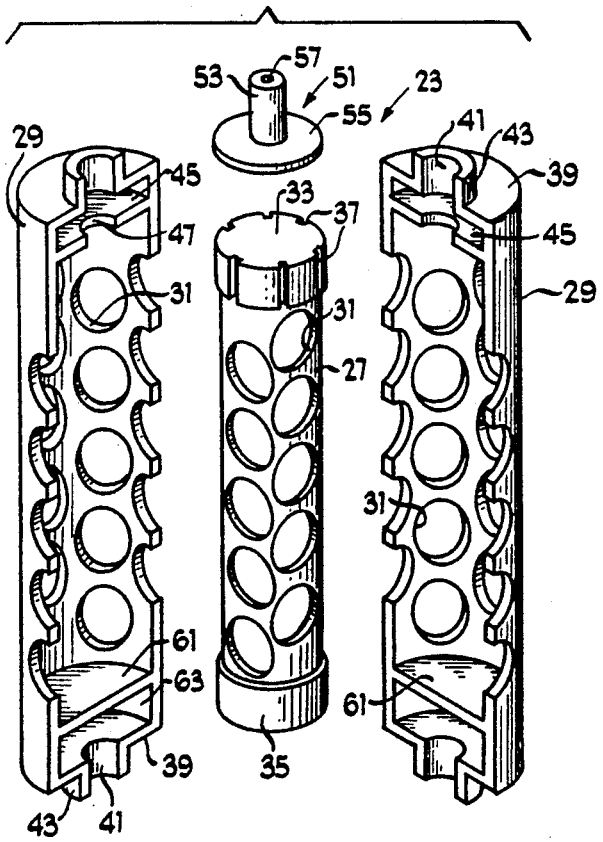
FIG. 3 is an enlarged, exploded view of one of the bubble diffusors.

As shown in FIGS. 3 and 4, each bubble diffusor 23 consists of a pair of coaxial tubes 27 and 29, each of which is considerably larger in diameter than the vinyl tube 21. An annular space 30 is provided between the tubes. Each of the bubble diffusor tubes is formed of a suitable plastic and is provided with openings 31 extending through its cylindrical walls with the openings 31 in the inner tube 27 aligned with the openings 31 in the outer tube 29, as shown in FIG. 4, to provide unimpeded passages through the handle. The liquid bubble producing solution spreads across the openings 31 as it does across the top of a bubble pipe or across the opening in a bubble wand so that air moving through the openings 31 can create bubbles.

Figure 5:
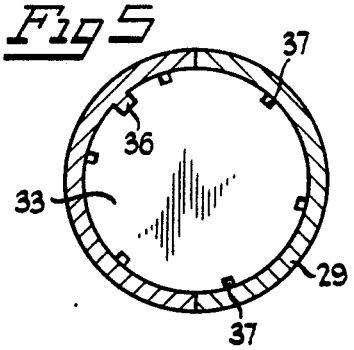
FIG. 5 is a cross-sectional view taken along line 5—5 of FIG. 4.

The ends of the inner coaxial tube 27 are closed by caps 33 and 35. Caps 33 and 35 extend radially outwardly of coaxial tube 27 to engage the tube 29 and define the annular space 30 between the tubes. A rib 36 formed integrally with the outer tube 29 extends inwardly, as seen in FIGS. 4 and 5, to contact the inner tube 27 to maintain the annular space 30. Slots 37 are formed in the outwardly-extending annular portion of cap 33 to provide access to the annular space 30 for the liquid bubble producing solution.

The outer coaxial tube 29 has a circular wall 39 at each end. A circular opening 41 is centrally located in each end wall and each opening is surrounded by an outwardly-extending sleeve 43. A partition 45 is formed in the tube 29 adjacent to but inwardly of the end wall 39 at the end of the tube adjacent the flexible tube 21. This partition has a central opening 47 which aligns with the opening 41 in the end wall of the tube. a nozzle 51 having a tubular portion 53 and a disk portion 55 fits into the tube 29 with its tubular portion 53 extending through the opening 47 in the partition 45 and the opening 41 in the end wall 39 to fit into the end of the flexible tube 21, as shown in FIG. 4. The disk portion 55 engages the partition 45 to hold the nozzle in position. A passage 57 in the nozzle provides communication for the flow of the bubble solution from the flexible tube 21 to the slots 37 in the cap 33 and into the annular space 30 between the coaxial tubes 27 and 29.

A solid partition 61 is located adjacent the opposite end of the coaxial tube 29 to form a chamber 63 between the end wall 39 and the partition 61. An end of the rope 13 is extended into this chamber and a wire twist 65 is applied to the rope to anchor the rope to the bubble diffusor 23.

Figure 6:
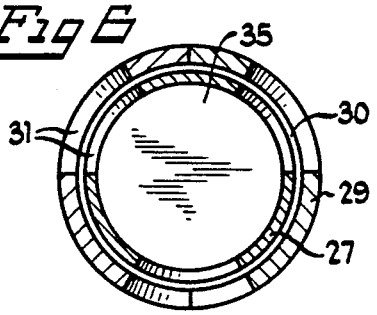
FIG. 6 is a cross-sectional view taken along line 6—6 of FIG. 4.

As can be seen in FIG. 3., the coaxial tube 29 is formed in two longitudinal sections. The coaxial tube 27, its end caps 33 and 35, the nozzle 51 and the rope 13 with its twist 65 applied are installed in place before the two longitudinal sections of the coaxial tube 29 are fastened together. Fastening of the sections can be accomplished in any conventional manner such as by the use of adhesives, solvents, ultrasonic welding, etc. The tube 27 may also be formed of two longitudinal sections fastened in the same manner as can be seen in FIG. 6.

While it is apparent that the overall length of the novelty jump rope 11 can be varied, depending on whether it is to be used by adults or children, the variation in length will normally be taken up in the rope-like portion 13. The overall length of the bubble producing means 15 is established so that these means will not normally touch the ground as a child or adult jumps rope, but instead will be positioned about the user's knees during rope jumping. The handles 17 are easily filled with a conventional liquid bubble producing solution by removing the screw-on caps 19, filling the reservoir or cavity in the handle with solution and reinstalling the cap. As the child jumps rope, the bubble solution is forced across the openings 31 in the coaxial tubes 27 and 29 and air passes through these openings to form bubbles. The rotation of the jump rope will force the bubbles centrifugally out through the bubble diffusors 23.

We claim:

1. A novel jump rope, including:

an elongated, flexible assembly having opposite ends, a handle located at each opposite end of said assembly, at least one of said handles being hollow and adapted to contain a liquid bubble-forming solution, at least one bubble diffusor positioned in said assembly between said liquid bubble-forming solution containing handle and said handle at said opposite end, a flexible fluid transporting tube connecting said hollow handle and said bubble diffusor, and a flexible element connecting said bubble diffusor and said other handle.

2. The jump rope of claim 1 in which said bubble diffusor includes a tubular member having air passages extending through the circular wall thereof, and means to distribute a liquid bubble-forming solution across said air passages as the jump rope is rotated to form and discharge bubbles.

3. The jump rope of claim 2 in which said tubular member is formed of coaxial tubes with an annular space located between said coaxial tubes, said air passages extending through the circular wall of said tubular member are formed by aligned openings in said coaxial tubes, and said means to distribute a liquid bubble-forming solution across said air passages includes means to distribute the liquid bubble-forming solution in said annular space.

4. A novel jump rope, including:

a pair of handles, a flexible, elongated rope located intermediate said handles, and a bubble distributing means positioned between each handle and said flexible elongated rope, said bubble distributing means including a bubble diffusor, a reservoir for liquid bubble-forming solution in said handle, and a flexible fluid transporting tube connecting the reservoir to the bubble diffusor.

5. A novel jump rope, including:

a pair of handles, a flexible elongated rope located intermediate said handles, at least one bubble diffusor positioned between one of said handles and said flexible elongated rope, a reservoir for a liquid bubble-forming solution formed in the one of said handles which is separated from said rope by said bubble diffusor, and a flexible liquid bubble-forming solution tube connecting said reservoir to said bubble diffusor.

* * * * *